United States Patent [19]

Drachenberg et al.

[11] 4,203,939

[45] May 20, 1980

[54] PROCESS AND APPARATUS FOR TREATMENT OF THE EXIT SURFACE OF SPINNERETS

[75] Inventors: Werner Drachenberg, Heinsberg; Heinrich Wolters, Waldfeucht, Fed. Rep. of Germany

[73] Assignee: Akzona Incorporated, Asheville, N.C.

[21] Appl. No.: 890,000

[22] Filed: Mar. 24, 1978

[30] Foreign Application Priority Data

Mar. 28, 1977 [DE] Fed. Rep. of Germany ..... 2713601

[51] Int. Cl.[2] ..... B29H 21/04

[52] U.S. Cl. ..... 264/130; 264/169; 264/176 F; 425/464

[58] Field of Search ..... 264/169, 39, 130, 176 F; 425/464, 90–97, 104, 107

[56] References Cited

U.S. PATENT DOCUMENTS

| | | | |
|---|---|---|---|
| 2,719,073 | 9/1955 | Olson | 264/169 |
| 3,056,163 | 10/1962 | Deis | 264/169 |
| 3,372,218 | 3/1968 | Bennie et al. | 264/169 |
| 4,034,034 | 7/1977 | Eberius et al. | 264/169 |

FOREIGN PATENT DOCUMENTS

| | | | |
|---|---|---|---|
| 1660497 | 9/1971 | Fed. Rep. of Germany . | |
| 43-522 | 1/1968 | Japan | 264/169 |
| 44-2492 | 2/1969 | Japan | 264/169 |

*Primary Examiner*—Jay H. Woo

*Attorney, Agent, or Firm*—Francis W. Young; Jack H. Hall

[57] ABSTRACT

Scraping agents such as silicone oils are applied, preferably continuously, to the circumference of the spinneret between the outer edge and the spinning holes nearest to it. Application is effected by means of a ring of an absorptive, surface active material, e.g., a ring wick located in a groove or a ring chamber which may be fitted with feed lines to supply the scraping agent.

14 Claims, 5 Drawing Figures

PROCESS AND APPARATUS FOR TREATMENT OF THE EXIT SURFACE OF SPINNERETS

The invention relates to a process for the treatment of the exit surface of spinnerets with a finish oil for the spinning of fibers from a melt, a device to apply the oil, and the use of the device in the production of filaments and fibers by the melt spinning process.

In melt spinning of suitable thermoplastic polymers, such as polyamide and polyester, the molten spinning mass is extruded through spinnerets provided, as a rule, with a plurality of orifices, also referred to as spinning holes or spinning bores.

In order to effectively melt spin synthetic filaments and fibers, the exit face of the spinnerets, i.e., the face of the spinneret from which the polymer exits from the spinneret, must be treated with a finishing oil, or scraping agent, which may, for example, consist of a solid coating of specific material. In most cases, however, the exit face is treated with a liquid material, especially silicone oil.

The finishing oil has multiple purposes. On the one hand, it acts as release agent and is intended to prevent adhesion of the polymer melt to the exit face during spinning. It also counteracts the formation of solid deposits, e.g., those caused by oligomers, which may cause a narrowing of the spinneret orifices or even obstruct them so completely that the desired amount of spinning mass per time unit no longer passes through the spinneret. The result is a fluctuating denier.

The finishing oil also acts as a so-called "scraping agent", to facilitate a mechanical cleaning procedure, in which the spinning process must be interrupted, whereby the exit face is freed by stripping or scraping it with a knife-like object to remove polymer melt and other deposits. The collection of such deposits, sometimes referred to as "dripping", may start at one or more spinneret orifices and may spread to other spinneret orifices.

Aside from the loss of time and material inherent in such more or less frequent interruptions, spinning malfunctions may also lead to an increase in so-called short spools. This is a substantial drawback, since in the textile industry one strives to have available spools of maximum size, each holding an uninterrupted filament, i.e. a filament without knots, or the like.

Efforts have tended so far to alleviate drawbacks of the above-described type by improving the treatment agents, especially the silicone oils. On the one hand, these improved agents should lower the number of spinning malfunctions, and on the other hand, make possible better cleaning of the spinning plate on a running machine.

In production, spinnerets are usually scraped at specific intervals of time, regardless whether or not there was a spinning malfunction, this being referred to as "scraping cycle". This maintenance procedure is, of course, cumbersome and labor-intensive, moreover a relatively large amount of waste is produced, but instead of waiting for unforeseeable spinning malfunctions, planned spinning interruptions are scheduled and, as a result, the number of unforeseen spinning malfunctions is reduced. Hence, unforeseen spinning malfunctions can only be partly prevented, since spinning malfunctions, requiring so-called interim scraping between scheduled scrapings within the scraping cycles, will still occur.

By improving the scraping agent, it has been possible to increase the scraping cycle and to reduce the number of interim scrapings. In spite of such progress, there is still an interest in increasing the scraping cycle and in having fewer interim scrapings. However, the difficulties encountered in applying the spinneret scraping agent have not been solved, irrespective of how good a scraping agent is used.

To insure a maximum of uniformity in spinning, a continuous and uniform film of oil must be present on the exit face of the spinneret. Losses through volatization of the agent due to the high temperature at the exit face of the spinneret must be replaced. Moreover, the filaments emerging from the spinneret continuously entrain small amounts of the oil which must also be replaced continuously. Consequently, additional amounts of spinneret scraping agent must be applied to the spinneret, not only prior to scraping, but also during spinning.

Replacement of scraping agent can be accomplished, e.g. by spraying silicone oil at specific time intervals on the spinneret orifices with a spray gun. The drawback to this procedure is that such spraying must be done with utmost care. If too much is sprayed on, a spinning malfunction may ensue immediately; if too little is used, the spinneret exit face will soon lose spinneret scraping agent, resulting in a spinning malfunction. It is, moreover, important that the spinneret be sprayed at a suitable angle. A maladjusted spray may lead to filament breakage. It has been found that even the fill level of the spray can may be a factor in achieving the best application of the spinneret scraping agent.

To avoid the above-described drawbacks in the discontinuous, manual application of silicone oils to the exit face of the spinneret, efforts have been made by others to insure a continuous supply of silicone oil to the spinneret exit face. German patent disclosure No. 1 660 497 describes spinnerets provided with oil reservoirs sunk into the exit face at a short distance from the extrusion orifices.

However, the manufacture of spinnerets of this type is much more complex than that of conventional spinnerets used for melt spinning. Furthermore, these spinnerets are much more difficult to clean, as they are easily damaged or destroyed during scraping or conventional cleaning processes.

There is therefore a need for further improvement and simplification of the processes to treat the exit face of spinnerets with finish oils for the spinning of fibers from the melt. Similarly, there is also a need for improved devices making it possible to effectively treat the spinneret exit face continuously with finish without experiencing the known difficulties.

The object of the invention is therefore to make available a process and a device making possible a simpler and more advantangeous application of the finish oil to the exit face of spinnerets for the spinning of fibers from the melt.

A further object of the invention is to insure that during the melt spinning process, a uniform silicone film is continuously present at the spinneret exit face.

Another object of the invention is to eliminate or reduce above-described drawbacks of the melt spinning process.

Another object of the invention is to make available a device, which can be used during the melt spinning process on conventional spinnerets, without requiring modification of the spinneret or expensive redesign of conventional spinning equipment.

These objects are met according to the invention by a process to treat the exit face of spinnerets with finish oil for the spinning of fibers from the melt, characterized in that the finish oil is applied to the circumference of the spinneret between the outer edge and the spinning orifices nearest to the outer edge. For the application of the finish oil, use is preferably made of an absorbent, surfactant material which is brought into contact with the spinneret surface at the circumference of the latter.

It is expedient to apply the finish oil evenly to a self-contained peripheral area. While it is advantageous to apply the finish oil continuously, the finish oil can also be applied intermittently at essentially equal time intervals. It is possible to apply the finish oil to individual points located at the periphery of the spinneret, and preferably, essentially equally spaced. Suitable finish agents are, in particular, creeping oils, thermally stable to at least 300° C. Silicone oils are especially satisfactory as finish oils, and may be stabilized with cerium compounds.

Several devices to apply finish oil to the circumference of a spinneret between its outer edge and the spinning orifices nearest to the outer edge, which will meet the above-described objectives, will be described with reference to the figures wherein.

Figure 1:
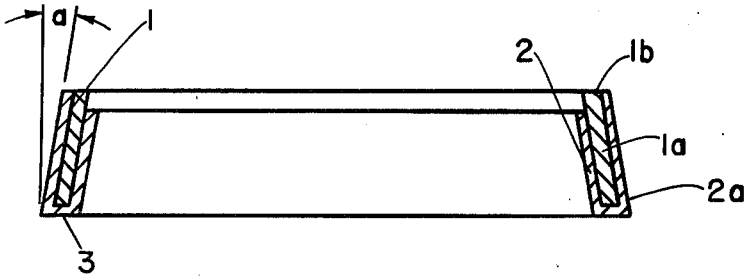
FIG. 1 shows a simplified embodiment of the invention.

The device of the invention may be characterized by a ring of absorbent, surfactant material for the finishing oil, with a contact zone serving to make contact with the circumference of the spinneret and a holding device for said ring. An exceptionally suitable holding device is a chamber open toward the face of the spinneret to accommodate the ring of absorbent, surfactant material, which may simultaneously be designed as reservoir for the finishing oil. Thereby, the holding device can be a simple groove able to accommodate the absorbent ring.

The absorbent ring is advantageously composed of a felt-like or sintered material retaining its absorbent, surfaetant characteristics to at least 300° C. Felt-like material useful in the invention can be made of inorganic fibers, e.g., asbestos, and can be provided with a support fabric of the same or different organic fibers. The sintered material may be made by known methods resulting in more or less porous materials using metals, metal alloys or ceramic materials, e.g., chromium-nickel alloys, iron, hard metals, magnesia. Other suitable materials are sintered metal sieves or fine sieves from vanadium steel wires with 16,000 members per $cm^2$.

The device of the invention can be designed in such a manner that the chamber- or groove-like holding devices of a spinning machine either in groups or individually are common to one or more spinneret faces via appropriate feed lines with reservoirs for the finishing oil.

Within the scope of the invention, conventional agents suitable for the treatment of melt spinnerets can be used as the finishing oil. It is, of course, understood that at the temperatures prevailing during the melt spinning process at the exit face of the spinneret, the oils creep on the metallic surface of the spinneret and therefore are able to wet the surface completely. Moreover, at the melt spinning temperatures, the oils being used should have a minimum of volatility. It is especially advantageous to use stabilized silicone oils. Details of suitable silicone oils and their stabilization are indicated in U.S. Pat. No. 4,034,034, incorporated in its entirety herein by reference.

The finishing oil is applied to the circumference of the spinneret between its outer edge and the spinning orifices nearest said outer edge. As is known, spinning orifices in a spinneret are generally arranged in regular alignment, e.g. in a honeycomb shape or ring shape. Between the outer edge of the spinneret and the spinning orifices nearest said outer edge there is a more or less wide peripheral area devoid of spinning orifices. It is sufficient, within the framework of the invention, to apply the finish oil to this peripheral area: it is not necessary to apply additional finish oil to other spots on the spinneret, for example, in the center.

It has surprisingly been found that oil applied to the periphery of the spinneret is evenly distributed to the inside of the spinneret exit face, and even that the oil reaches the center of the spinneret exit face within a short time, whereby a uniform, coherent film is formed.

The process of the invention is advantageously used for multi-orifice spinnerets; it is also within the scope of the invention to supply single-orifice spinnerets with a finishing oil, using an absorbent, surfactant material. Absorbent and surfactant within the scope of the invention implies that the material is able to take up the finishing oil as would a wick or sponge-like material and release it to the spinneret face. To this end, the absorbent, surfactant material is in direct contact with the spinneret face.

It has been found that a certain equilibrium state exists, which insures constant conditions at the spinneret. The surfactant material filled with the finishing oil releases only a certain amount of oil to the spinneret face until a coherent film is formed. Since the consumption of finishing oil during spinning is minute, it is often possible to provide an adequate film on the spinneret over a period of time without supplying additional finishing oil to the absorbent material. The surfactant material may, as required, be resupplied with finishing oil, e.g. by dipping it into the oil to saturate it with the finishing agent.

In treating the spinneret, one may first proceed by providing the untreated, dry spinneret around its periphery with finishing oil, while waiting until the oil is distributed evenly over the spinneret before starting the melt spinning process. This generally takes only a short time. It is, of course, also possible to initially provide the spinneret with an appropriate oil film, e.g. by spraying it, and thereafter to maintain constant film on the spinneret according to the process of the invention.

Expediently, the finishing oil is uniformly applied to a self-contained peripheral area, for example, in the case of circular spinnerets to a ring-shaped area circumscribing the area in which the spinneret orifices are located. In spinnerets of different geometrical configuration, e.g. rectangular spinnerets, this self-contained peripheral area assumes the configuration of the corresponding margin zone, i.e. rectangular.

The finishing oil is, preferably, applied continuously, which can be accomplished by leaving the absorbent material in continuous contact with the circumference of the spinneret. The finish oil may also be applied discontinuously whereby oil is applied until an adequate film has formed, then breaking the contact between spinneret, face and absorbent material and only resuming treatment at a later stage. With this discontinuous, intermittent procedure, it is advantageous to apply the finishing oil at regular intervals of time.

It is not absolutely necessary to apply the finishing oil over the entire, self-contained peripheral area. In many cases, it is expedient and adequate to apply the oil to individual points of the periphery. It may thus be enough to apply the finishing oil to two, three or four point on the spinneret's periphery, preferably to separate, essentially equidistant, points.

One device to apply finishing oil to the periphery of a spinneret between the latter's outer edge and the spinning orifices nearest to said outer edge consists essentially of the absorbent, surfactant material provided with a contact zone to make contact with the periphery of the spinneret face and a holding device for the absorbent material. Examples of suitable absorbent, surfactant materials are referred to previously herein.

The shape of the holding device matches that of the spinneret; in other words, its geometrical configuration is such that it fits on the periphery of the spinneret between the latter's outer edge and the spinning orifices nearest said outer edge. In the case of spinnerets whose orifices are arranged in a circular pattern, a circular, ring-shaped configuration is preferred for the holding device.

An especially advantageous version of the device of the invention is shown in FIG. 1. The holding device consists of a ring-shaped or circular chamber 1 to accommodate an annular-shaped piece of absorbent material 1*a*. The chamber 1 is formed of concentric circular walls 2, 2*a* in mutually parallel alignment connected by a bottom wall 3. The chamber is open at the top, i.e., in a direction toward the exit face of the spinneret. The outer wall 2*a* is approximately flush with the contact zone 1*b* of the absorbent ring and higher than the inner wall 2. The circular walls preferably assume an angle, , from the vertical, of from 5° to 30°.

A ribbon-shaped, absorbent material is very easily inserted into a device of this type.

It is, of course, not absolutely necessary that the device have a cone angle, it may also be designed as annular chamber, with two concentric, cylindrical rings connected by an appropriate annular chamber floor, as lateral walls. The ring chamber may also have a tubular cross section with suitable openings on the side facing the spinneret while oil is being applied. An annular chamber of this type is easily made from an appropriate tube segment by connecting both ends of the segment and by providing slits or similar openings in the annular structure. The openings in the annular chamber may be continuous or discontinuous, preferably at regular intervals in the latter case.

Figure 2:
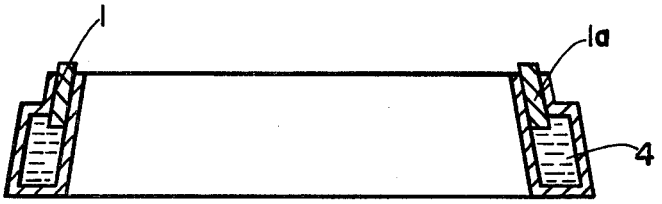
FIG. 2 shows a device similar to FIG. 1, containing an integral reservior.

The holding device may be designed as a chamber with an appropriate opening onto the spinneret face allowing the absorbent material to protrude from the chamber and thus to make direct contact with the periphery of the spinneret. The chamber may simultaneously be designed as reservoir for the finish oil. This can be accomplished, as shown in FIG. 2, by having the chamber flare out at the lower end thereof to form a reservoir 4 which may be filled with finishing oil. The lower part of the absorbent material 1*a* is then in continuous contact with the finishing oil and its continuously saturated with oil so that it can release appropriate amounts of oil to the face of the spinneret from the contact zone 1*b* of the absorbent, surfactant material.

In many cases, it is quite enough if the holding device is designed as a simple groove serving merely to enclose and hold the absorbent material in order to bring it into contact with the spinneret face.

Figure 3:
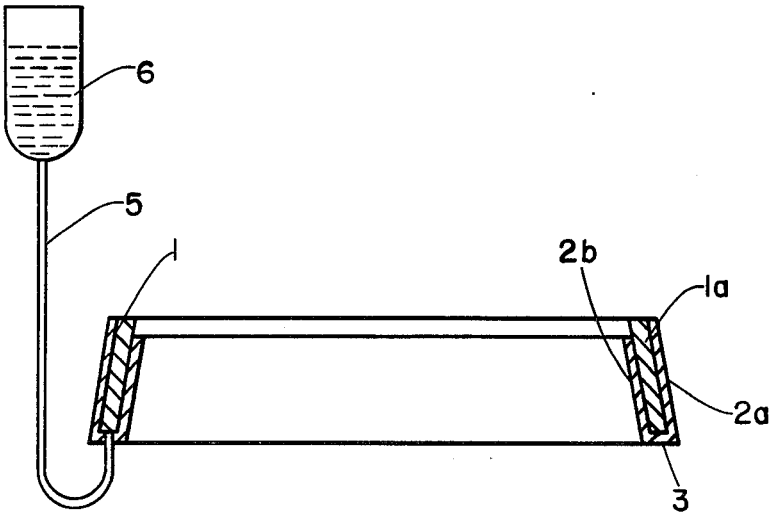
FIG. 3 shows a device similar to FIG. 1, having an external reservoir.

The chamber or groove-like holding devices intended to accommodate the absorbent material may be connected by way of an appropriate feed line 5 with a reservoir 6 for the finishing oil, as shown in FIG. 3. On a spinning machine with a plurality of spinnerets, the chamber- or groove-like holding devices can be provided, in groups or individually, with reservoirs for the finishing oil having appropriate feed lines to the absorbent, surfactant ring holding device.

Although a metering device, e.g. a pump, may be installed in the feed line between the reservoir and the holding device, it is not essential since a uniform supply of finish oil can be supplied to the spinneret surface simply by having a certain hydrostatic pressure in the feed line, which can be accomplished, e.g. by mounting the reservor at a specific height.

The distance from the point at which oil is released onto the periphery of the spinneret by contact with the absorbent material, to the nearest spinning orifice, for example, the orifices of the outermost orifice circle of a spinneret, may vary between relatively wide limits. However, this distance is preferably between 4 and 10 mm.

The distance between the inner and outer annular walls of the chamber-like holding device, is expediently from 3 to 5 mm and should, as a rule, not exceed 6 mm.

To treat the spinneret face, the device is placed against the exit face of the spinneret and appropriately fastened so that the contact zone of the absorbent material makes proper contact with the periphery of the spinneret. It is possible to fasten the device by means of suitable screw joints so that it rests solidly on the spinneret. This can be accomplished, e.g. by providing the outside of the annular chamber with a screw thread so that it can be screwed to a corresponding thread far enough to sit solidly on the spinneret. The device can also be screwed on with separate screws to insure solid contact with the spinneret.

Figure 4:
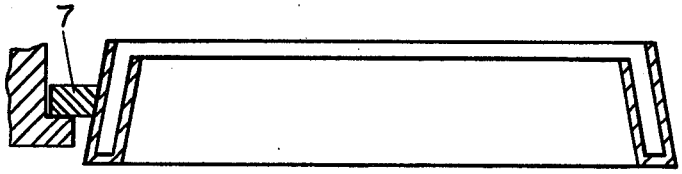
FIG. 4 shows a device with a preferred mounting means.

The device shown in FIG. 4 is provided with a bayonet joint 7, which facilitates mounting.

Figure 5:
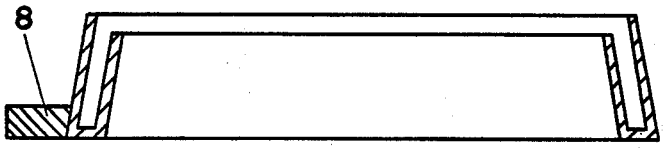
FIG. 5 shows a device with magnetic mounting means.

The device may also be equipped with magnets 8, as shown in FIG. 5, which permit fastening.

The process and device of the invention are especially suitable for melt spinning synthetic fibers from conventional polymers like polyesters and polyamides. A coherent, uniform film of oil is constantly present on the spinneret, making possible a considerable lengthening of the scraping cycle time. Apart from a reduction in labor expenditures for scraping, a substantial reduction in the waste accruing during spinning malfunctions and scraping is achieved. The finishing oil does not be applied manually so that all drawbacks resulting from operator errors are eliminated. It was especially surprising that according to the invention a constant, adequate finish film can be obtained on the spinneret without special provisions for metering, since the device is essentially self-monitoring. The outer annular wall need not be equipped with a special gasket on the side in contact with the exit face of the spinneret, since the oil migrates selectively not to the outside but to the inside in the direction of the spinning orifices. With the process and/or devices of the invention, one or more spinnerets can be uniformly supplied with a finishing oil. The spinnerets to be treated may have two or more orifice circles or a plurality of orifices in various arrangements, e.g. a honeycomb-like pattern. Moreover, according to the invention, spinnerets used for the production of fiber tow having 1000 or more spinning orifices may be treated in accordance with the invention.

A special advantage is that the process of the invention can be used in conventional melt spinning processes and that the device of the invention can be installed without extensive changes on all conventional spinnerets. Provisions need merely be made in the spinning chimney or on the spinneret, for appropriate mountings, e.g. of ferromagnetic material or with suitable screw threads or bayonet joints.

By means of the invention, all conventional spinneret finishing agents can be properly distributed on the spinneret with substantial increases in the length of the scraping cycle. A scraping cycle of 14 days or more can be readily achieved. In a test run of 21 days, significantly better results were achieved using the device described herein compared to a control run using conventional scraping procedures. The results are shown in the following table:

| | Scraping Cycle (Hours) | Spinning breaks per ton | Drawing breaks per ton |
|---|---|---|---|
| Test Run using improved device | 504 | less than 1 | 10 |
| Control Run | 21 | 3 | 13 |

What is claimed is:

1. A process for treating the exit face of spinnerets having a plurality of orifices with a finishing oil selected from creeping oils, which are thermally stable at temperature of at least about 300° C., for the spinning of fibers from a melt, comprising applying the finishing oil uniformly only to a peripheral zone on the face of said spinneret located between the outer edge and the spinneret orifices nearest said outer edge by means of an absorbent, surfactant material in contact with the spinneret face at said peripheral zone.

2. The process of claim 1 wherein said finishing oil is applied continuously.

3. The process of claim 1 wherein said finishing oil is applied intermittently at essentially regular time intervals.

4. The process of claim 1 wherein said finishing oil is applied to separate, essentially equally spaced points on said peripheral zone.

5. The process of claim 1 wherein said finishing oil is a silicone oil.

6. The process of claim 5 wherein said silicone oil is stabilized with a cerium compound.

7. A device for applying a finish oil to the face of a spinneret having multiple orifices at a peripheral surface between its outer edge and the spinning orifices nearest said outer edge, comprising a ring of an absorbent, surfactant material having a spinneret contact zone in the shape of said peripheral surface, and a holding device for said ring comprising a chamber open toward the spinneret face and a reservoir for said finish oil.

8. The device of claim 7 wherein said holding device comprises an outer wall and an inner wall, said outer wall being higher than the inside wall and the upper end of said outer wall is approximately flush with the contact zone of the absorbent ring.

9. The device of claim 8 wherein said chamber comprises two concentric circular walls connected by a floor.

10. The device of claim 9 wherein said walls assume an angle with the vertical of between 5° and 30°.

11. The device of claim 7 wherein said absorbent ring consists of a felt-like or sintered material retaining to at least 300° C. its absorbent, surfactant properties.

12. The device of claim 11 wherein said felt-like material comprises inorganic fibers.

13. The device of claim 11 wherein said sintered material is a metal, metal alloy or a ceramic material.

14. The device of claim 13 wherein a plurality of holding devices are each provided either in groups or individually, with a plurality of reservoirs interconnected by feed lines.

* * * * *